US008720993B2

(12) United States Patent
McCoy

(10) Patent No.: US 8,720,993 B2
(45) Date of Patent: May 13, 2014

(54) STOOL WITH TOP EXTENSION

(76) Inventor: Eric Dean John McCoy, Milton (CA)

( * ) Notice: Subject to any disclaimer, the term of this patent is extended or adjusted under 35 U.S.C. 154(b) by 156 days.

(21) Appl. No.: 13/251,551

(22) Filed: Oct. 3, 2011

(65) Prior Publication Data

US 2013/0082503 A1 Apr. 4, 2013

(51) Int. Cl.
*A47C 9/00* (2006.01)

(52) U.S. Cl.
USPC ..... 297/195.11; 297/243

(58) Field of Classification Search
USPC ..... 297/4, 195.11, 232, 233, 461, 423.1, 297/423.11, 423.12, 243
See application file for complete search history.

(56) References Cited

U.S. PATENT DOCUMENTS

| | | | | | |
|---|---|---|---|---|---|
| 384,887 | A | * | 6/1888 | Brott | 248/188.91 |
| 969,347 | A | * | 9/1910 | Davis | 297/311 |
| 1,004,975 | A | * | 10/1911 | Blackman | 224/415 |
| 1,242,407 | A | * | 10/1917 | Wood | 297/332 |
| 3,446,532 | A | | 5/1969 | Cramer | |
| 3,863,980 | A | | 2/1975 | Ciner | |
| 4,085,686 | A | * | 4/1978 | Turner et al. | 108/25 |
| 4,930,839 | A | * | 6/1990 | Saito et al. | 297/338 |
| 5,435,623 | A | | 7/1995 | Kapec et al. | |
| 5,536,067 | A | | 7/1996 | Pinto | |
| 5,927,797 | A | | 7/1999 | Ferguson | |
| 6,578,918 | B1 | | 6/2003 | Rinne et al. | |
| 6,752,459 | B2 | | 6/2004 | Deisig | |
| 6,959,716 | B1 | * | 11/2005 | Schrader | 135/66 |
| 7,234,780 | B2 | * | 6/2007 | Lipniarski | 297/461 |
| 7,293,827 | B2 | * | 11/2007 | Schrader | 297/195.11 |
| 7,350,863 | B2 | | 4/2008 | Engels et al. | |
| 7,401,850 | B2 | * | 7/2008 | Micheel | 297/16.2 |
| 7,413,254 | B2 | * | 8/2008 | Petre, Jr. | 297/440.1 |
| 7,845,717 | B2 | * | 12/2010 | Leng | 297/16.1 |
| 8,292,370 | B1 | * | 10/2012 | Hygh | 297/461 |
| 2003/0230915 | A1 | * | 12/2003 | Checketts | 297/195.11 |
| 2007/0187997 | A1 | * | 8/2007 | Smith | 297/16.1 |

* cited by examiner

*Primary Examiner* — David R Dunn
*Assistant Examiner* — Alexander Harrison
(74) *Attorney, Agent, or Firm* — Young Basile Hanlon & MacFarlane PC

(57) ABSTRACT

A stool for supporting an adult and child includes a plurality of floor engaging legs extending substantially vertically and a seat mounted rigidly on the legs. The seat includes a main seating portion arranged horizontally and having a top surface for the adult to sit on and a bottom connected to at least some of the legs. The main seating portion has a rounded perimeter extending through an arc of at least 180°. The seat has a tongue portion integrally attached to the main seating portion and projecting horizontally from one side. The tongue portion has a top surface for the child to sit on and two opposite edges which taper inwardly towards an outer end. The adult and child are able to sit adjacent each other on the stool. In an exemplary version, the main seating portion has a minimum horizontal width of at least 35 cm.

6 Claims, 3 Drawing Sheets

STOOL WITH TOP EXTENSION

FIELD OF THE INVENTION

This invention relates to stools on which people can sit.

BACKGROUND OF THE INVENTION

Stools have been known for many years and are commonly used for seating purposes both indoors and outdoors. They can be made of a variety of materials, including wood, metal and rigid plastic. One common form of stool is made with a round or square top forming a sitting surface and a plurality of legs extending downwardly from the top and attached thereto. Often there are four legs which can be connected to one another by means of horizontal struts or bars. The top seat can be made of solid wood or metal forming a hard seat or the top can be covered with some form of padding. In general, such stools are only able to support one person with the size of the person that can be supported depending upon the size and strength of the stool.

U.S. Pat. No. 5,435,623 issued Jul. 25, 1995 describes a stool which includes an articulated seat whose front segment is hinged to a rear segment. The rear segment is mounted on a depressible spring mechanism supported on a stand that normally raises the seat to a perching mode level. This stool, which is intended for one person only, is provided with a vertical stand that is supported on a multi-legged base that rests on the floor. The front segment of the seat is operatively linked to the rear segment by means including a lever arm pivotally connected at its upper and to the underside of the front segment.

U.S. Pat. No. 5,536,067 issued Jul. 16, 1996, describes a chair with a seat back, a floor engaging support, and a seat mounted on the support. The seat includes a posterior and leg supporting seating portion that can be moved with respect to the support between a horizontal plane and a forward downward inclined plane in which a user assumes a kneeling-like sitting posture. This chair also has a crotch supporting tongue for supporting the user when he or she is in the kneeling-like sitting posture.

U.S. Pat. No. 5,927,797, which issued on Jul. 27, 1999, describes a so-called portable work stool that includes a seat which is secured to and carried by the user adjacent the user's posterior when standing and moving about. The stool has a single, variable length support leg attached to the seat. The exemplary version is a narrow seat similar to a narrow bicycle seat. Thus, the seat has a relatively narrow front portion and a wider, rounded rear portion to which straps are attached. This work stool can also be provided with a pair of side stabilizers to prevent the stool from tipping too far over sideways.

Although it is common to provide a chair or a stool in a washroom facility to allow a user to sit down, the chair or stool is suitable generally for only one person and it may only be suitable for an adult or only for a child, depending upon the size of the particular chair or stool.

Often it is necessary for a parent to sit a small child in front of a washroom mirror or to at least have the child sit down so that the parent can brush the child's teeth, brush the child's hair, or wash the child's face. Sometimes parents have seated their children on a bathroom counter which can be relatively high, necessitating the parent to lift the child up and sit him or her on the counter. This can present a danger to the child since the counter is relatively high and there is a risk that the child could fall from the counter, particularly if the parent is distracted or is required to leave the child for a brief period of time in order to obtain a brush, wash cloth or some other item.

There thus is a need for an improved seating arrangement which not only allows the child to be seated while being attended to by a parent, but also allows the parent to sit down close to the child.

SUMMARY OF THE PRESENT DISCLOSURE

According to one embodiment of the present disclosure, a stool for supporting both an adult human and a small child includes a plurality of floor engaging legs extending substantially vertically and a seat mounted rigidly and fixedly on the legs so as to provide a stable seating surface. The seat includes a main seating portion arranged substantially horizontally and having a top surface for the adult human to sit on and a bottom connected to at least some of the legs. The main seating portion has a rounded, horizontally extending perimeter extending through an arc of at least 180 degrees. The seat also has a tongue portion integrally attached to the main seating portion and projecting horizontally from one side thereof. The tongue portion has a top surface for the child to sit on and two opposite side edges which taper inwardly towards an outer end of the tongue portion. During use of this stool, the adult human and child are able to sit adjacent each other on the stool.

In a particularly exemplary embodiment of this stool, the main seating portion has a minimum horizontal width of at least 35 cm and the tongue region tapers to a rounded front end section having a horizontal width of about 10 cm.

According to another embodiment of the present disclosure, a stool for supporting an adult human and a small child at the same time includes a floor engaging support which in use is self-supporting on a horizontal floor and an extended seat mounted rigidly and fixedly on the support so as to provide a stable seating surface. The seat includes a main seating portion arranged horizontally and having a top surface for the adult human to sit on and a bottom connected to the support. The main seating portion has a rounded horizontal perimeter. The seat further includes a tongue portion rigidly and integrally attached to the main seating portion and projecting horizontally from one side thereof. The tongue portion has a top surface for the child to sit on and has at least an outer section with a maximum horizontal width substantially less than the maximum horizontal width of the main seating portion measured perpendicular to a longitudinal central axis of the tongue portion. The main seating portion has a horizontal width of at least 30 cm measured perpendicular to the longitudinal central axis of the tongue portion.

In an exemplary version of this stool, the floor engaging support includes four vertically extending legs each rigidly connected to the bottom of the main seating portion and inclined outwardly from a top end of the leg to a bottom end thereof. One of these legs can be arranged directly below a longitudinal centerline of the tongue portion and a support strut extends between and is fixedly connected to the one leg and the tongue portion.

A further embodiment of the present disclosure comprises a backless stool for supporting both an adult human and a small child sitting in front of the adult human on the stool. The stool comprises a plurality of floor engaging legs extending vertically and a substantially horizontal seat mounted rigidly on the tops of the legs so as to provide a stable seating surface for both the adult human and the child. The seat includes a horizontal main seating portion having a top surface on which the human adult can sit and a bottom connected to at least some of the legs. This seating portion has a horizontal width of at least 30 cm. The seat also has a tongue portion integrally and rigidly attached to the main seating portion and projecting horizontally from one side thereof. The tongue portion has a top on which the child can sit and two opposite side edges which taper inwardly towards an outer end of the tongue portion so that the child can straddle the tongue portion while sitting thereon. A rigid support strut member extends between at least one of the legs and an outer end section of the tongue portion.

In a particular exemplary version of this stool, the main seating portion has a minimum horizontal width of 35 cm and the tongue portion tapers towards a rounded front end section having a horizontal width of about 10 cm.

These and other aspects of the disclosed stools will become more readily apparent to those having ordinary skill in the art from the following detailed description taken in conjunction with the accompanying drawings.

BRIEF DESCRIPTION OF THE DRAWINGS

So that those having ordinary skill in the art to which the present disclosure pertains will more readily understand how to make and use the subject invention, exemplary embodiments thereof will be described in detail herein below with reference to the drawings, wherein.

DETAILED DESCRIPTION OF EXEMPLARY EMBODIMENTS

Figure 1:
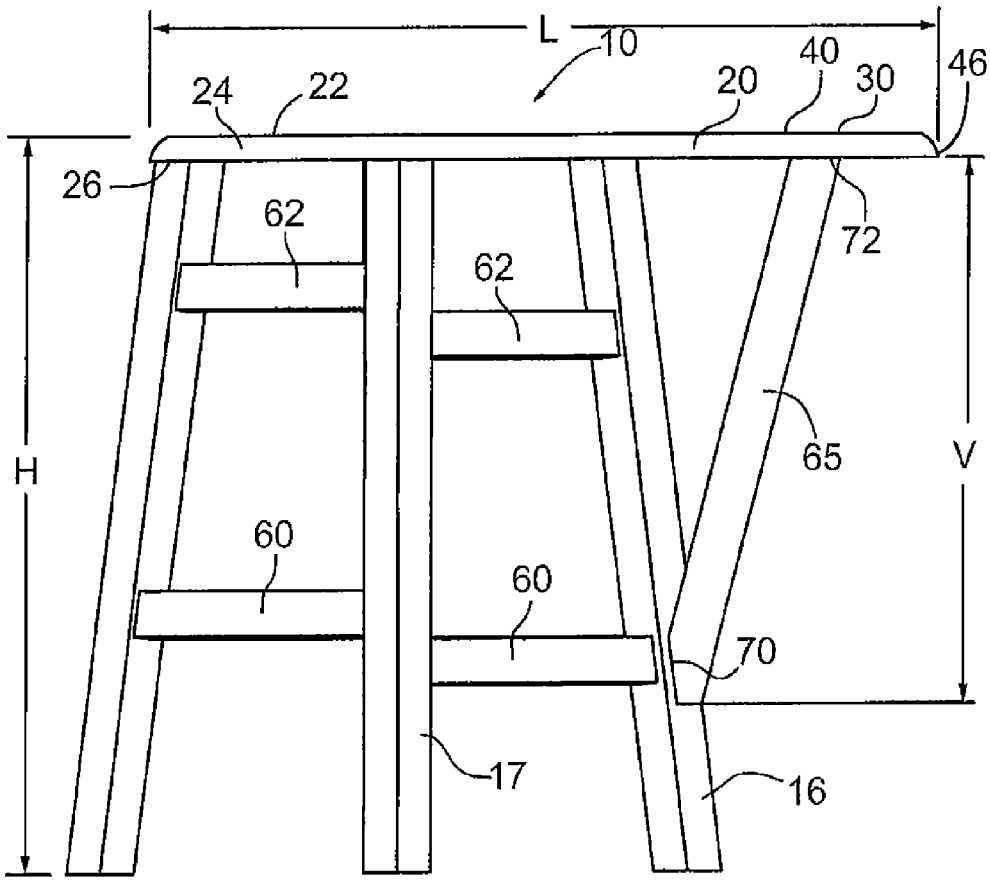
FIG. 1 is a side elevation of a stool according to the present disclosure.
Figure 2:
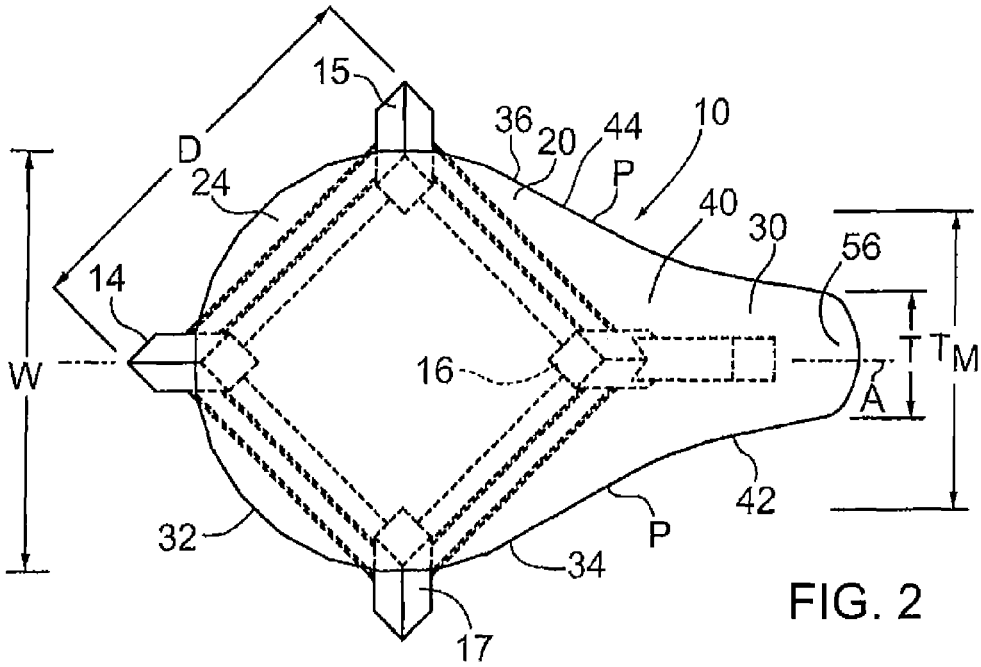
FIG. 2 is a top view of the stool of FIG. 1.
Figure 4:
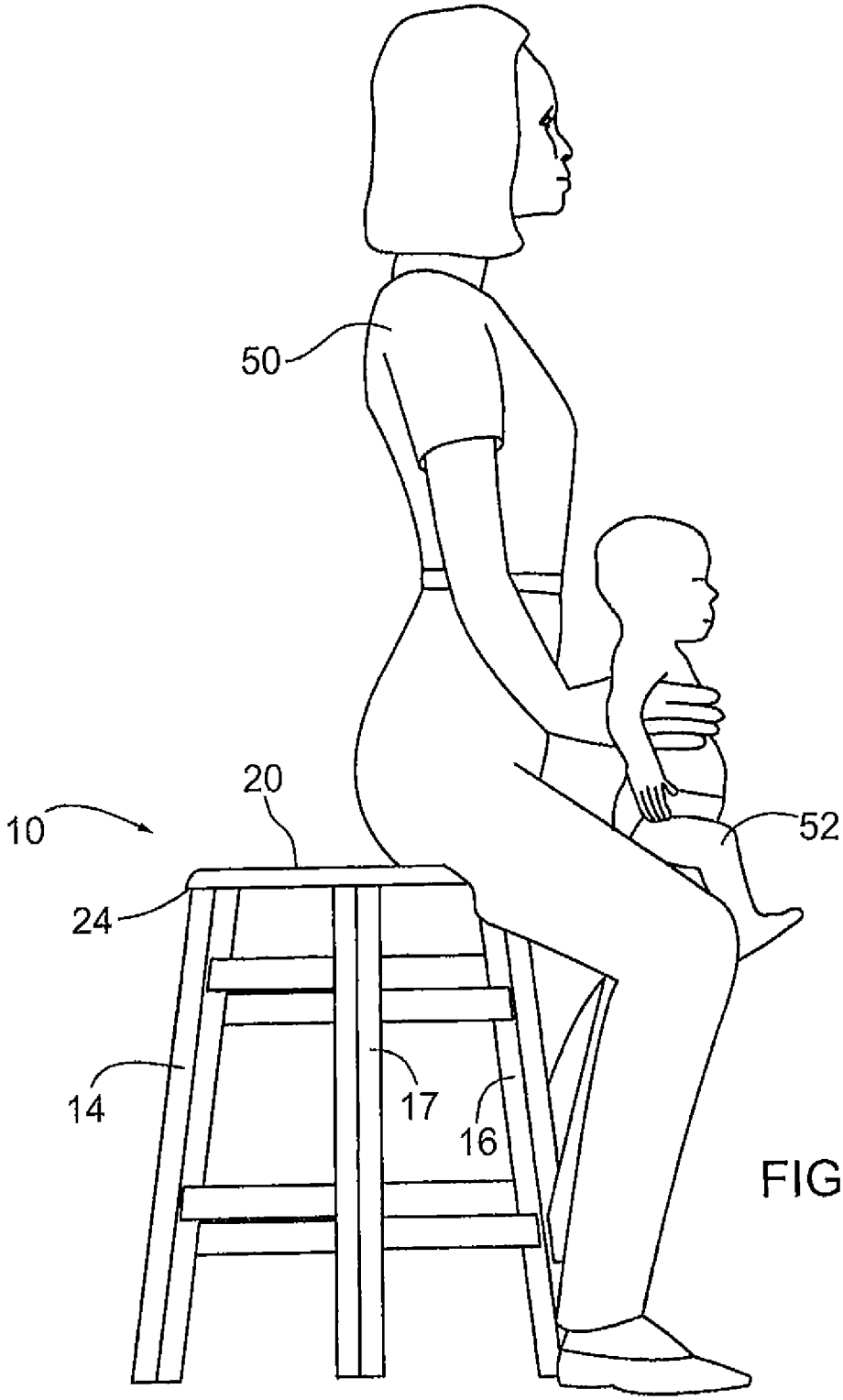
FIG. 4 is a schematic side elevation showing the stool of FIG. 1 being used by an adult and a small child.

FIGS. 1, 2 and 4 illustrate a stool 10 for supporting both an adult 11 human and a young or small child 13, including a child with special needs, who may need assistance in a washroom or elsewhere for a task such as the brushing of his or her hair or his or her teeth. As with a standard stool, the stool 10 includes a floor engaging support which can be self-supporting on a horizontal floor indicated at 12. In the illustrated embodiment, the floor engaging support comprises a plurality of floor engaging legs 14 to 17, only three of which are visible in FIG. 1. It will be appreciated that the number of legs can vary and there can be as few as three legs or more than four. Three legs may be suitable for a stool that is low in height, in which case stability of the stool becomes less important.

The stool has a seat 20 rigidly and fixedly mounted on the legs so as to provide a stable seating surface 22. The seat includes a main seating portion 24 arranged substantially horizontally and having a top surface for the adult human to sit on and a bottom 26 connected to all or at least some of the legs 14 to 17. In the illustrated embodiment, the three legs 14, 15 and 17 are connected at their top ends to the main seating portion 24 while the top end of the leg 16 is connected at a transition between the main seating portion and a tongue portion 30. The main seating portion has a rounded, horizontally extending perimeter which can be in the form of a rounded edge and which extends through an arc of at least 180°. As illustrated in FIG. 2, the perimeter 32 extends through an arc greater than 180° extending approximately from point 34 to point 36 on the opposite side of the seat. In the exemplary embodiment, the main seating portion 24 has a minimum horizontal width of at least 30 cm (this width indicated at W), and in one particular exemplary embodiment, the width W is 35 cm. The legs and seat can be made of standard rigid materials such as wood, metal and rigid plastic including suitable polymers and resin materials.

The tongue portion 30 is integrally attached to the main seating portion and projects horizontally from one side thereof. The tongue portion has a top surface 40 for the child to sit on and two opposite side edges 42, 44 which taper inwards towards an outer end 46 of the tongue portion. As shown in FIG. 4, during use of the stool 10, the adult human 50 and the child 52 are able to sit adjacent each other on the stool. In particular, the adult is able to sit on the main seating portion directly behind the child who is sitting on the tongue portion, the two of them facing in the same direction, for example, facing a bathroom mirror.

The exemplary tongue portion tapers to a rounded front end section 56 and a particularly exemplary version of this front end section has a horizontal width of about 10 cm, this width indicated at T in FIG. 2. It will be appreciated that the relatively narrow width of the tongue portion at this location makes it easy and comfortable for a child to sit at this location on the stool. Also, in the exemplary illustrated tongue portion, the two opposite sides or side edges 42, 44, define horizontally extending concave curves tending to make the seat of the stool more comfortable for the adult to sit in the manner shown in FIG. 4. It will be appreciated that at least an outer section of the tongue portion 30 has a maximum horizontal width which is substantially less than the maximum horizontal width W of the main seating portion and is perpendicular to a longitudinal central axis A of the tongue portion. In order for the main seating portion to be comfortable for most adults, the horizontal width W is at least 30 cm measured perpendicular to the longitudinal central axis A. Furthermore, in the illustrated embodiment, the tongue portion 30 tapers from a horizontal width indicated at $T_M$ of at least 14 cm to the horizontal width T near its outer end of about 10 cm. In a particular exemplary embodiment, the maximum horizontal width of the tongue portion at point P is 14 cm. The point P is located approximately where the concave curve of each opposite side edge 42, 44 commences.

In order to increase the strength of the supporting legs, they can be connected together by means of horizontally extending struts or braces. As illustrated, the stool 10 has four lower braces 60, each extending between a respective pair of adjacent legs and four upper braces 62. The braces can be constructed of wood, a suitably strong metal, such as steel or stainless steel, or a suitably strong, rigid plastic. The braces can be attached in any suitable manner such as by means of threaded fasteners and/or adhesive. In one embodiment, the two lowermost braces 60 are positioned 15 cm above the floor while the two lowermost upper braces 62 are positioned 15 cm below the seat 20. The position of these braces can vary depending upon the overall size, construction and desired strength of the stool.

The exemplary stool 10 includes a rigid support strut member 65 extending between at least one of the legs and an outer end section of the tongue portion 30. This strut member can be made of wood or metal and it extends vertically a distance indicated at V in FIG. 1. In one particular exemplary embodiment, the distance V is about 30 cm with the strut member extending at a slight angle to vertical as shown. In the embodiment of FIG. 1, the support strut has a bottom end 70 connected to one leg, namely, the leg 16 and a top end at 72 connected to the outer section of the tongue portion 30. The illustrated strut member is inclined outwardly from its bottom end. It will be seen from FIGS. 1 and 2 that the leg 16 is arranged directly below the longitudinal centerline A of the tongue portion. The support strut member 65 extends between and is fixedly connected to the leg 16 and the tongue portion. Due to the inclination of the legs and, in particular, the leg 16, and the length and position of the strut member, the stool 10 is quite stable, even in the situation where only the child is sitting on the stool and is sitting on the tongue portion 30.

In an exemplary version of the stool, the four legs form of the corner of a square, with each side measuring about 37 cm, this distance being indicated by the distance D in FIG. 2. The total height of this exemplary stool is 56 cm, this distance indicated at H in FIG. 1. The length of the seat in the direction of the longitudinal centerline A can vary to some extent. An exemplary range for this length indicated at L is 50 to 55 cm and in the particular exemplary embodiment shown in FIG. 1, the length L is 54 cm.

Figure 3:
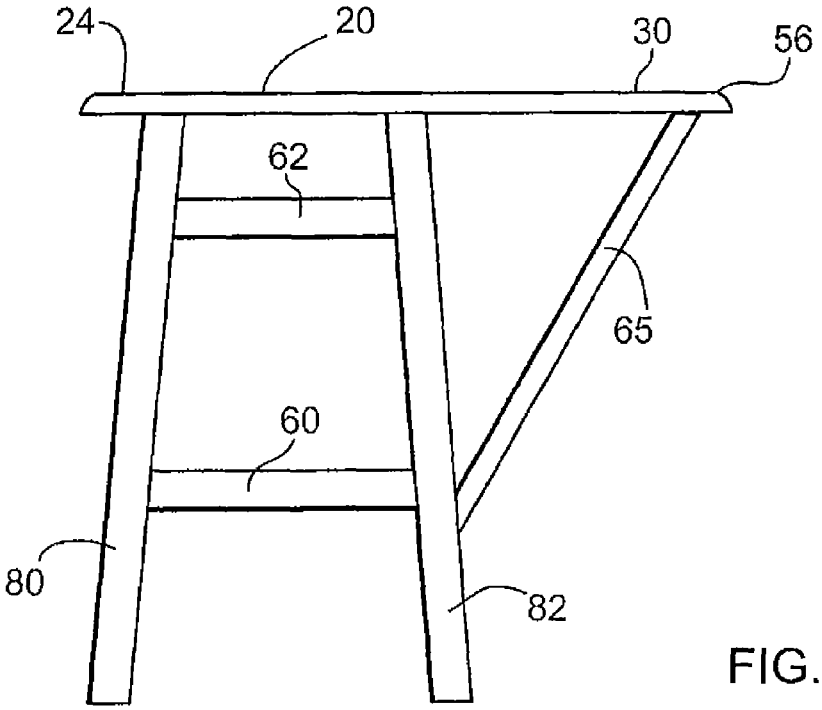
FIG. 3 is a side elevation of an alternate embodiment of a stool constructed according to the present disclosure.

FIG. 3 illustrates an alternative arrangement for the four legs connected to the bottom of the seat 20. Two of these legs 80, 82 can be seen in FIG. 3 while the other two legs are hidden from view behind the legs 80, 82. In this arrangement, two legs are located on each side of the longitudinal centerline of the seat. This arrangement for the four legs may be more comfortable for some users of the stool. In this embodiment, the strut member 65 can be connected at its bottom end to one of the lower braces 60 rather than directly to one of the legs.

While the present invention has been illustrated and described as embodied in exemplary embodiments, e.g. embodiments having particular utility as stools capable of holding both an adult and a child, it is to be understood that the present invention is not limited to the details shown herein, since it will be understood that various omissions, modifications, substitutions and changes in the forms and details of the disclosed stool and its use may be made by those skilled in the art without departing in any way from the scope of the present invention. For example, those of ordinary skill in the art will readily adapt the present disclosure for various other applications without departing from the scope of the invention.

The invention claimed is:

1. A stool for simultaneously accommodating an adult and a smaller child on a support surface thereof in an arrangement wherein the adult sits immediately behind the child, and the adult and child are facing in the same direction, wherein the stool comprises:

a quadrilateral arrangement of four legs of rigid material wherein the legs flare outwardly from top to bottom to provide a stable support;

a rigid seat surface permanently attached to the tops of the four legs and having a fore and aft axis of symmetry which is aligned diagonally across an opposed set of legs in said quadrilateral arrangement of legs, wherein the seat surface comprises a main portion of sufficient width and depth as to accommodate a seated adult and, integral with said main portion, a forwardly extending progressively narrower tongue portion with a rounded forward end which lies forward of the arrangement of legs for accommodating the child seated thereon; and a rigid brace having a bottom end attached to one of the legs in the diagonal pair of legs which lie along the aforesaid axis of symmetry, said brace extending upwardly and forwardly to an attachment point under said tongue to provide a stable support for the adult and child while simultaneously seated on the support surface of the stool;

all of the legs, support surface and brace being made of a durable rigid material; the main seating portion having a horizontal width crosswise to said axis of symmetry of at least 30 cm and the support surface measured along said axis of symmetry having a length of at least 50 cm.

2. A stool according to claim 1 wherein said stool has a height of at least 56 cm.

3. A stool according to claim 1 wherein said support strut extends at least 30 cm in the vertical direction.

4. A stool according to claim 1 wherein said tongue portion has two opposite side edges defining horizontally extending concave curves.

5. A stool according to claim 1 wherein said main portion of said seat surface has a rounded horizontally extending edge extending though an arc of at least 180°.

6. A stool according to claim 1 wherein the main portion has a maximum horizontal width crosswise to said axis of symmetry of at least 35 cm.

* * * * *